US007896532B2

(12) United States Patent
Hsu et al.

(10) Patent No.: US 7,896,532 B2
(45) Date of Patent: Mar. 1, 2011

(54) LED LUMINESCENT DEVICE AND VEHICLE LAMP COMPRISING THE DEVICE

(75) Inventors: Jih-Tao Hsu, Taipei (TW); Chun-Ching Lai, Dali (TW); Yu-Jen Chuang, Kaohsiung (TW)

(73) Assignee: Automotive Research & Testing Center, Changhua Hsien (TW)

( * ) Notice: Subject to any disclaimer, the term of this patent is extended or adjusted under 35 U.S.C. 154(b) by 183 days.

(21) Appl. No.: 12/189,233

(22) Filed: Aug. 11, 2008

(65) Prior Publication Data

US 2010/0033985 A1 Feb. 11, 2010

(51) Int. Cl.
*F21V 7/00* (2006.01)

(52) U.S. Cl. ..... 362/518; 362/507; 362/538; 362/520

(58) Field of Classification Search ..... 362/545, 362/538, 539, 507, 516, 517, 518
See application file for complete search history.

(56) References Cited

U.S. PATENT DOCUMENTS

| | | | | |
|---|---|---|---|---|
| 6,547,416 | B2 * | 4/2003 | Pashley et al. | 362/231 |
| 6,617,781 | B2 * | 9/2003 | Murazaki et al. | 313/486 |
| 7,073,931 | B2 * | 7/2006 | Ishida | 362/539 |
| 7,537,366 | B2 * | 5/2009 | Inoue et al. | 362/547 |

* cited by examiner

*Primary Examiner* — Ali Alavi
(74) *Attorney, Agent, or Firm* — Alan Kamrath; Kamrath & Associates PA

(57) ABSTRACT

An LED luminescent device includes an LED light source, a reflector, a light shade and a projecting lens. The LED light source includes at least one LED element having a light-emitting surface emitting light. The reflector faces the light-emitting surface of the at least one LED element and has multiple reflection surfaces of different curvatures reflecting the light from the light-emitting surface of the at least one LED element. The light shade adjusts the light reflected by the reflector to provide a required light distribution pattern. The projecting lens project the required light distribution pattern. Thus, the device and a vehicle lamp including the device can prevent losing light energy.

1 Claim, 5 Drawing Sheets

LED LUMINESCENT DEVICE AND VEHICLE LAMP COMPRISING THE DEVICE

BACKGROUND OF THE INVENTION

1. Field of Invention

The present invention relates to a luminescent device and, more particularly, to an LED luminescent device and vehicle lamp comprising the device that can utilize light energy more efficiently.

2. Description of the Related Art

Because LEDs (light-emitted diodes) have characteristics of low power consumption, small size and long life span, they are applied more and more extensively to light sources, such as headlights, turn signal lamps or brake lamps for vehicles.

A conventional LED luminescent device for vehicle lamps comprises an LED light source, a reflector, a light shade and a light cover. The LED light source has a light-emitting surface that emits light toward an upper direction. The reflector is disposed above the light-emitting surface of the LED light source and reflects the light from the light-emitting surface toward a front direction. The light shade is disposed in front of the LED light source for providing a required light distribution pattern. The light cover is disposed in front of the light shade.

However, because the reflector of the conventional LED luminescent device has a reflection surface with a single curvature, the reflector can only collect the light from the light-emitting surface directed towards the upper and front directions. For this reason, the light from the light-emitting surface directed towards a rear direction is hard to be collected by the reflector and is wasted. Additionally, the light of the reflection surface with a single curvature cannot effectively converge on the position of the light shade, so some of the light energy is lost and wasted.

To overcome the shortcomings, the present invention provides an LED luminescent device and vehicle lamp comprising the device to mitigate or obviate the aforementioned problems.

SUMMARY OF THE INVENTION

The primary objective of the present invention is to provide an LED luminescent device and vehicle lamp comprising the device that can prevent losing the light.

An LED luminescent device in accordance with the present invention comprises an LED light source, a reflector, a light shade and a projecting lens. The LED light source comprises at least one LED element and the at least one LED element, has a light-emitting surface. The reflector faces the light-emitting surface of the at least one LED element and has multiple reflection surfaces with different curvatures reflecting the light from the light-emitting surface of the at least one LED element. The light shade adjusts the light reflected by the reflector to provide a required light distribution pattern. The projecting lens project the required light distribution pattern.

Preferably, the at least one LED element comprises two trapezoidal LED elements that are arranged to form a rectangle.

Preferably, the projecting lens is an aspherical lens.

Preferably, each trapezoidal LED element is a high brightness LED of 200 lm.

Preferably, the reflection surfaces comprise a first reflection surface and a second reflection surface. The first reflection surface is disposed over the at least one LED element. The second reflection surface is disposed in rear of the at least one LED element.

Preferably, the second reflection surface is an afterglow composite reflection surface.

Preferably, the reflection surfaces are at a distance of more than 20 mm from the at least one LED element.

A vehicle lamp in accordance with the present invention comprises multiple of the foregoing LED luminescent devices.

Other objectives, advantages and novel features of the invention will become more apparent from the following detailed description when taken in conjunction with the accompanying drawings.

DETAILED DESCRIPTION OF THE INVENTION

Figure 1:
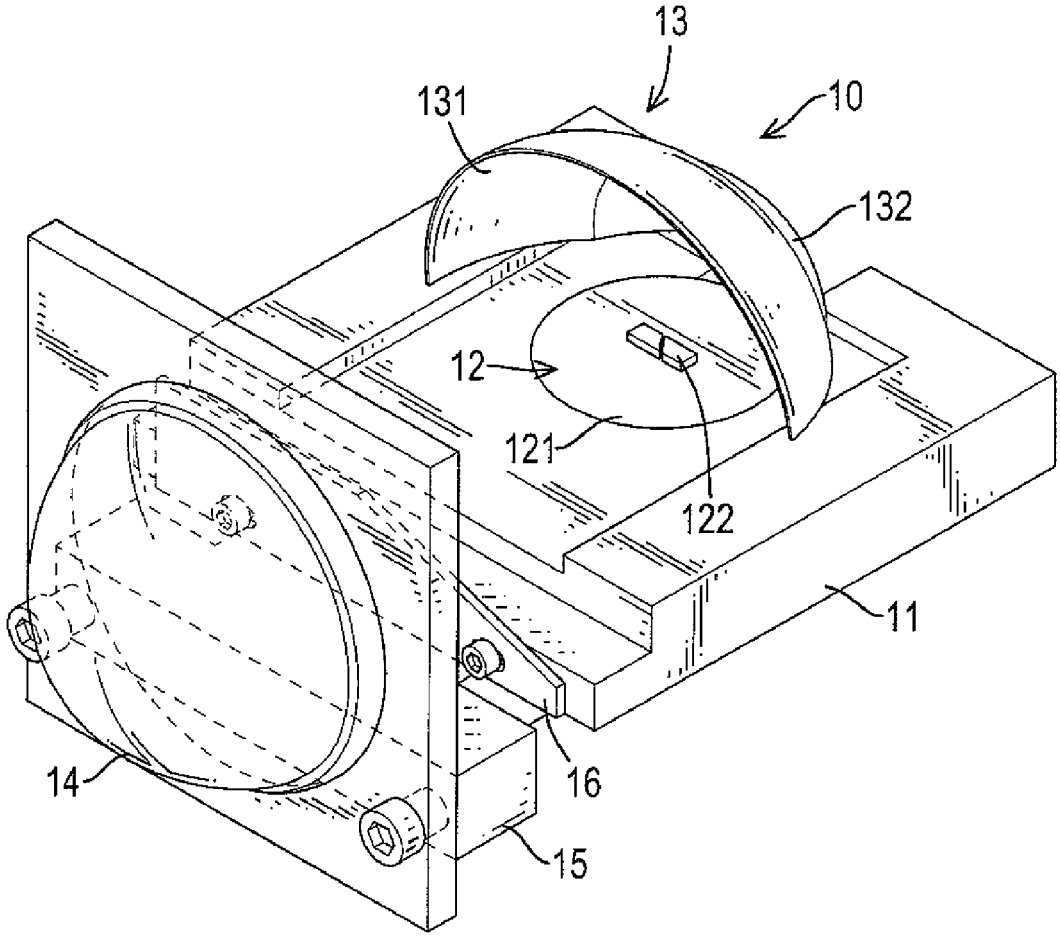
FIG. 1 is a perspective view of an LED luminescent device in accordance with the present invention.
Figure 2:
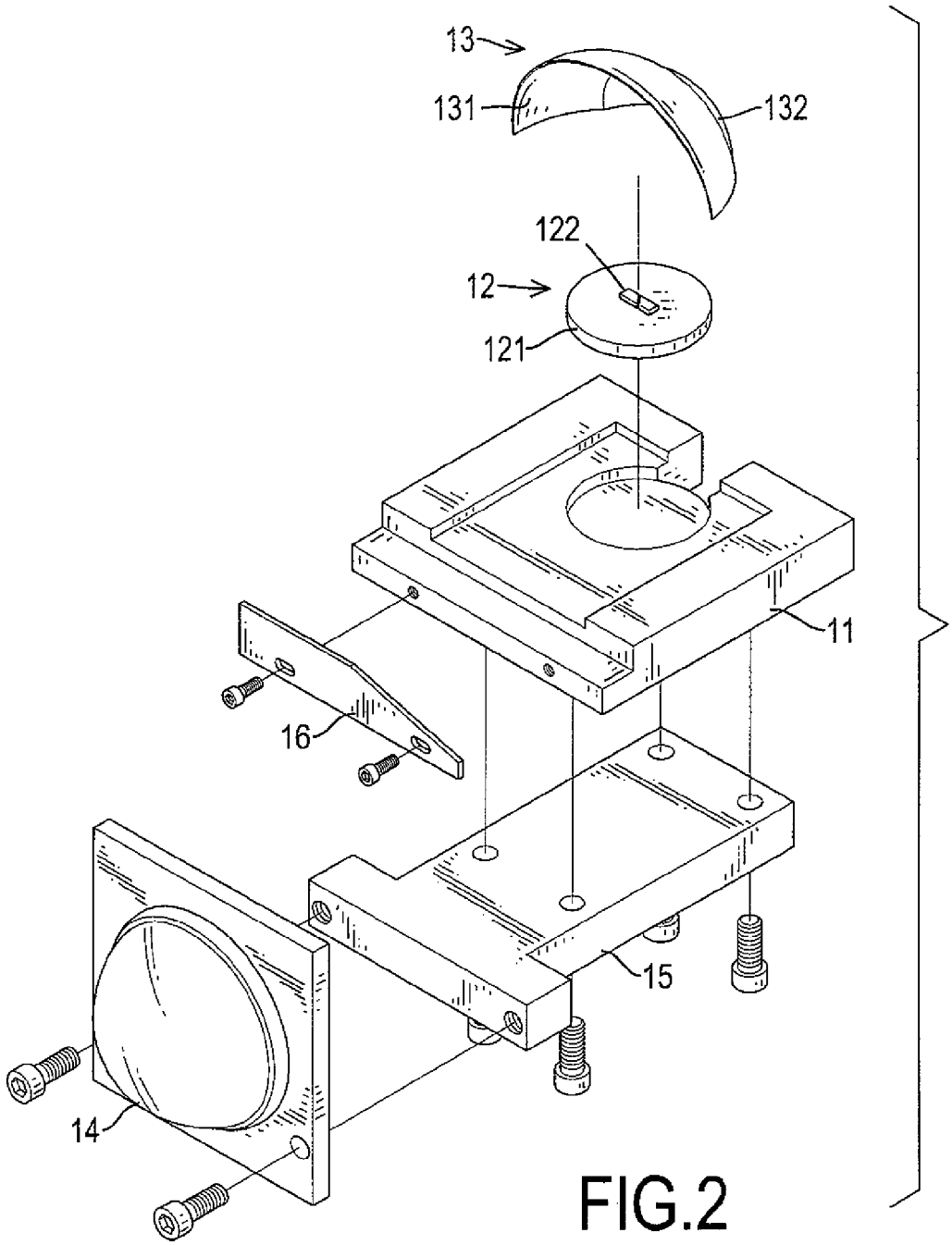
FIG. 2 is an exploded perspective view of the LED luminescent device in FIG. 1.
Figure 3:
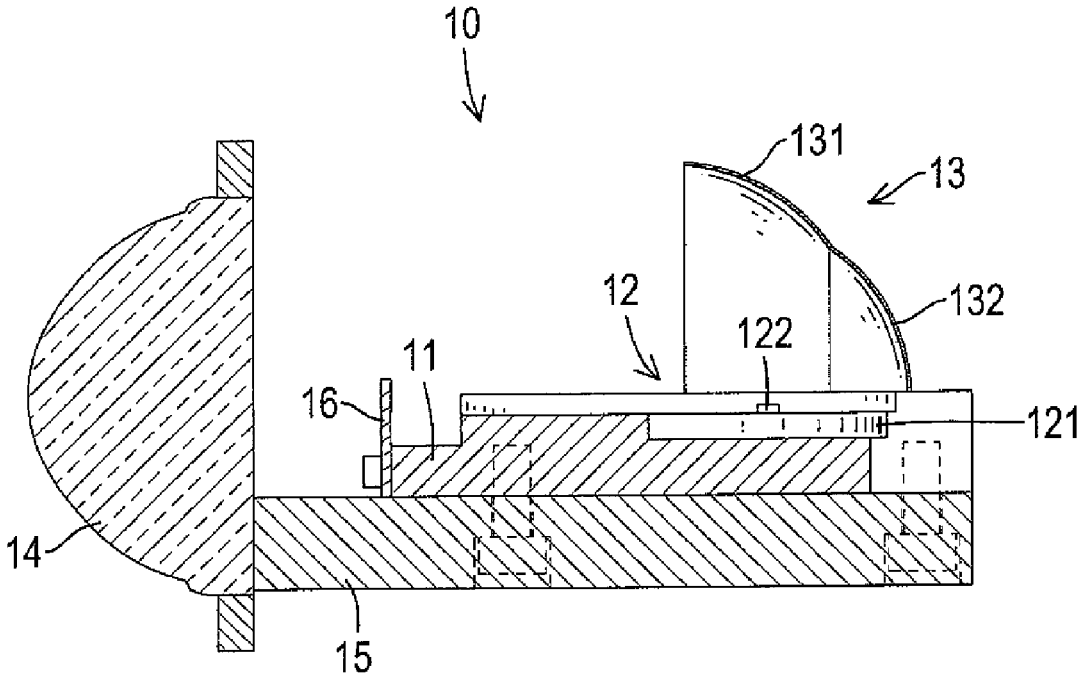
FIG. 3 is a cross-sectional side view of the LED luminescent device in FIG. 1.

With reference to FIGS. 1 to 3, an LED luminescent device (10) in accordance with the present invention comprises a support (11), an LED light source (12), a reflector (13), a projecting lens (14), a base (15) and a light shade (16).

The support (11) is rectangular and has a top surface, a bottom surface, a front end and a cavity formed on the top surface.

The LED light source (12) is mounted on the cavity of the support (11) and may comprise a fastening pedestal (121) and at least one LED element (122). The fastening pedestal (121) is mounted in the cavity of the support (11). The at least one LED element (122) is mounted on the fastening pedestal (121) and has a light-emitting surface directed towards an upper direction. The at least one LED element (122) may comprise two trapezoidal LED elements each including a perpendicular surface and an inclined surface extending between first and second parallel surfaces. The two trapezoidal LED elements are arranged with their inclined surfaces facing each other to form a rectangle. Each one of the at least one LED element (122) may be a high brightness LED of 200 lm (lumen). Thus, the LED light source (12) may provide a light pattern and brightness distribution that meet a criterion of a vehicle headlight.

The reflector (13) is disposed above the at least one LED element (122), faces the light-emitting surface of each one of the at least one LED element (122) and has a gap in front of the at least one LED element (122). The reflector (13) has multiple reflection surfaces that may comprise a first reflection surface (131) and a second reflection surface (132), and the reflection surfaces (131) (132) may be at a distance of more than 20 mm from the at least one LED element (122). Furthermore, the curvature of the first reflection surface (131) differs from the second reflection surface (132). The first reflection surface (131) is disposed over the at least one LED element (122) to reflect the light from the at least one LED element (122) to a front direction. The second reflection surface (132) is connected to the first reflection surface (131) and is disposed in rear of the at least one LED element (122) to reflect the light from the at least one LED element (122) to the front direction. Thus, the second reflection surface (132) can collect and reflect the light originally lost and can serve as an afterglow composite reflection surface. Additionally, the reflection surfaces (131) (132) of different curvatures can reflect the light from the at least one LED element (122) to a predominated position.

Figure 4:
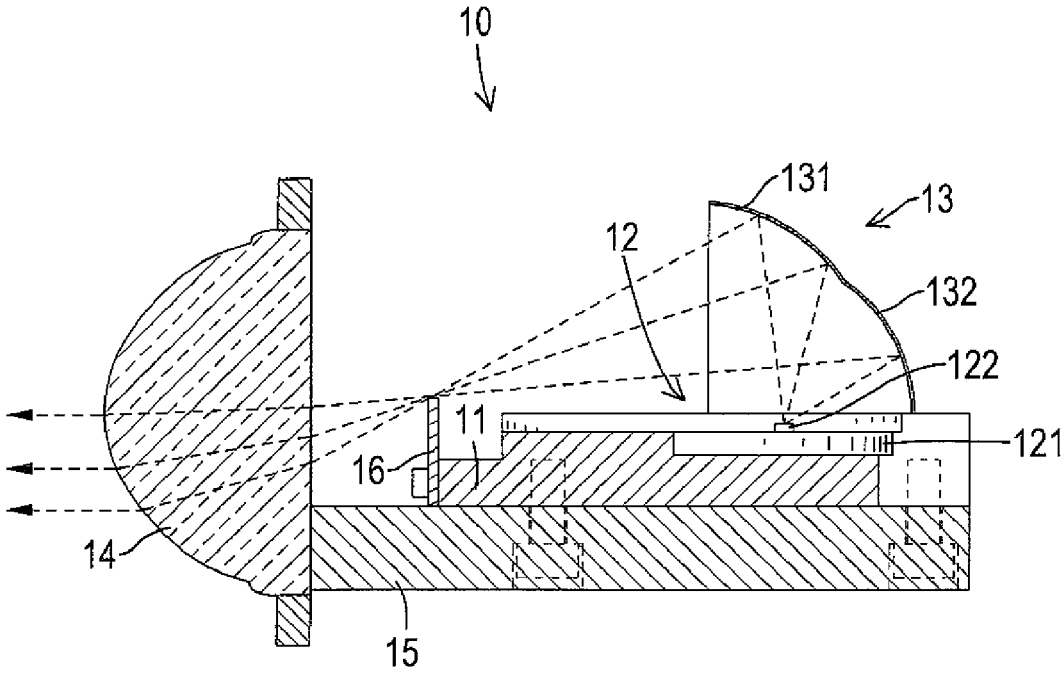
FIG. 4 is an operational cross-sectional side view of the LED luminescent device in FIG. 1.

With reference to FIG. 4, the light shade (16) is disposed in front of the LED light source (12) and has a top edge higher than the top surface of the support (11) so as to adjust the light reflected by the reflector (13) to provide a required light distribution pattern.

The projecting lens (14) is disposed in front of the reflector (13), corresponds to the gap of the reflector (13) and projects the required light distribution pattern. The projecting lens (12) is spaced from the reflector (13) and may be an aspherical lens.

The base (15) is mounted on the bottom surface of the support (11) and has a front end protruding from the front end of the support (11) and connected to the projecting lens (14).

Because the reflector (13) has the second reflection surface (132) in rear of the at least one LED element (122) to collect the originally lost light directed towards a rear direction, the originally lost light is reflected by the second reflection surface (132) to the front direction. The originally lost light converges near the top edge of the light shade (16) with the light reflected by the first reflection surface (131). Thus, the light energy can be utilized efficiently without wasting.

Figure 5:
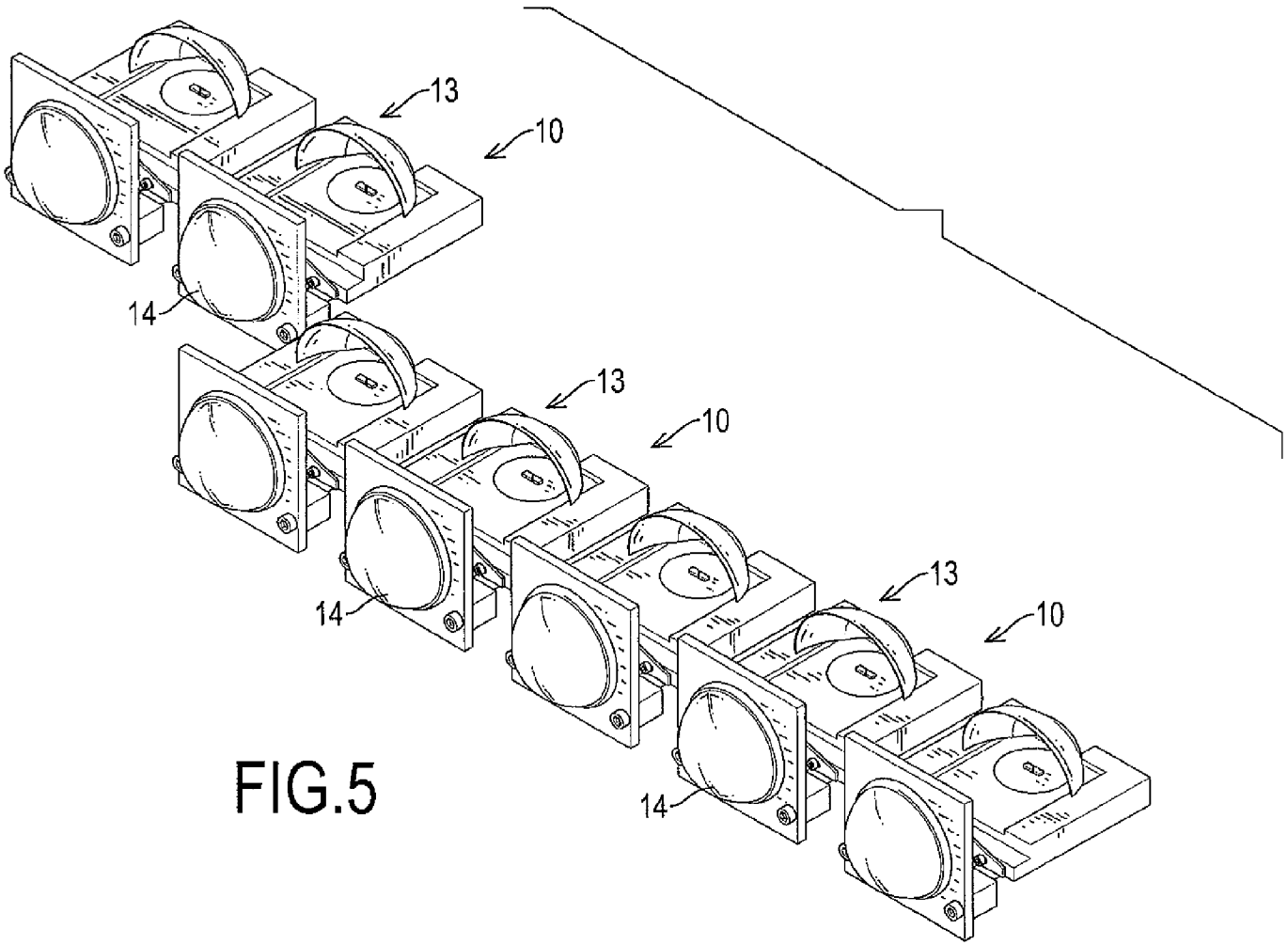
FIG. 5 is a perspective view of a vehicle lamp in accordance with the present invention.

With reference to FIG. 5, a vehicle lamp in accordance with the present invention comprises multiple LED luminescent devices (10) as described. Thus, the vehicle lamp has a large scale and may serve as a head lamp, turn signal lamp or other vehicle lamp.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An LED luminescent device comprising:

a light emitting diode (LED) light source comprising first and second trapezoidal LED elements having a light-emitting surface emitting light, with the first and second trapezoidal LED elements each having first and second parallel surfaces, a perpendicular surface extending between the first and second surfaces, and an inclined surface extending between the first and second surfaces, with the inclined surfaces of the first and second trapezoidal LED elements facing each other to form a rectangle, wherein each trapezoidal LED element is a high brightness LED of 200 lm;

a reflector facing the light-emitting surface of the first and second trapezoidal LED elements and having multiple reflection surfaces of different curvatures reflecting the light from the light-emitting surface of the first and second trapezoidal LED elements, wherein the reflection surfaces are at a distance of more than 20 mm from the LED light source, wherein the reflection surfaces comprise a first reflection surface disposed over the LED light source; and a second reflection surface disposed in rear of the LED light source, wherein the second reflection surface is an afterglow composite reflection surface;

a light shade adjusting the light reflected by the reflector to provide a required light distribution pattern; and a projecting lens projecting the required light distribution pattern, wherein the projecting lens is an aspherical lens.

* * * * *